United States Patent [19]

Bartlett

[11] 4,200,261

[45] Apr. 29, 1980

[54] HANDRAIL AND CRASH RAIL

[75] Inventor: Gary F. Bartlett, Muncy, Pa.

[73] Assignee: Construction Specialties, Inc., Cranford, N.J.

[21] Appl. No.: 970,325

[22] Filed: Dec. 18, 1978

[51] Int. Cl.[2] ..... E04H 17/14

[52] U.S. Cl. ..... 256/59; 52/718; 248/345.1

[58] Field of Search ..... 256/59, 65, 66; 248/345.1; 52/718

[56] References Cited

U.S. PATENT DOCUMENTS

| | | | |
|---|---|---|---|
| 2,685,147 | 8/1954 | Burr | 248/345.1 |
| 3,825,229 | 7/1974 | Bartlett | 256/59 |
| 3,842,564 | 10/1974 | Brown | 256/59 X |
| 3,991,537 | 11/1976 | Brown | 248/345.1 X |

*Primary Examiner*—Andrew V. Kundrat

*Attorney, Agent, or Firm*—Brumbaugh, Graves, Donohue & Raymond

[57] ABSTRACT

A handrail and crash rail comprises a rigid retainer and a cover of a resilient, impact-resistant plastic mounted on the retainer by means of upper and lower flanges on the cover which engage and are held on corresponding flanges on the retainer. Clearances are left between the impact wall of the cover and the front surfaces of the retainer flanges so that the cover can deflect inwardly toward the retainer upon impact. At least one longitudinally extending, resiliently compressible cushion mounted on the retainer between the retainer flanges engages the impact wall of the cover to control the extent of deflection of the cover upon impact, absorb some of the energy of the impact, and restore the cover to its initial position after impact. Additional cushions can be included. Special internal and external corner assemblies and an end assembly are used with rail sections to form a complete rail system.

9 Claims, 7 Drawing Figures

HANDRAIL AND CRASH RAIL

BACKGROUND OF THE INVENTION

This invention relates to a shock-absorbing railing system and, in particular, to a combination handrail and crash rail.

The assignee of the present invention has for some years marketed a line of wall protection products for use in hospitals, nursing homes, hotels, airports and wherever pedestrian traffic or rolling equipment can damage walls and corners. Included in that line are two versions of handrails constructed according to U.S. Pat. No. 3,825,229. Those handrails consist of rigid retainers securely mounted on the wall and resilient impact-resistant plastic trim pieces mounted on the retainers in a manner which allows the trim piece to deform and deflect toward the retainer upon impact. The center parts of the trim pieces are unsupported and are free to flex and deflect toward the retainer. The prior handrails have proven very effective in preventing wall damage.

Another type of wall protection device is a so-called crash rail. One form of presently known crash rail comprises spaced-apart brackets mounted at intervals along the wall and an impact resistant crash member mounted on the brackets. The center part of the face of the crash member is free to bend upon impact almost all the way up to the wall surface, and the way in which the crash member is affixed to the brackets makes it rather easy for the crash member to become dislodged from the brackets. The crash member engages the wall and is not capable of serving as a handrail.

SUMMARY OF THE INVENTION

There is provided, in accordance with the present invention, a handrail and crash rail which combines the advantages of the greater width common to many presently known crash rail systems, thus enhancing the degree of protection for the wall surface due to a greater height of impact surface, and the ability to serve as a handhold for pedestrians.

More particularly, a handrail and crash rail, according to the present invention, comprises a substantially rigid, elongated retainer of uniform cross section along its length and having, in cross section, a medial portion and upper and lower flanges and a cover member of resilient impact-resistant polymeric material having an impact wall portion and upper and lower flanges. The respective upper and lower flanges of the retainer and cover are in engagement in a manner such that the cover is held on the retainer. The impact wall portion of the cover and the medial portion of the retainer are spaced apart to allow deflection of the cover toward the retainer upon impact. At least one elongated, longitudinally extending, resiliently compressible cushion is mounted on the medial portion of the retainer at a suitable location (or locations) between the retainer flanges and engages the impact wall portion of the cover to control deformation of the cover, to absorb energy upon impact and to restore the cover to its initial position after impact. Clearances are left between the front surfaces of the retainer flanges and the portions of the cover outwardly, relative to the wall, therefrom so that the impact wall portion of the cover can deflect toward the retainer throughout its vertical extent upon impact.

In a preferred embodiment, three vertically spaced-apart, longitudinally extending, resiliently compressible cushions are engaged between the retainer and cover intermediate the upper and lower flanges. The three cushions act together in permitting limited deflection of the cover toward the retainer upon impact and restoring the cover to its initial position after impact. Each cushion on the retainer is preferably mounted on a rib which projects toward the cover from the medial portion of the retainer, which provides a "stop" limiting maximum deflection of the cover, and which imparts longitudinal rigidity to the retainer.

Another aspect of the present invention involves internal and external corner assemblies and an end assembly for use with the basic rail to provide a complete rail system. The corner and end assemblies use substantially identical end caps and share certain other components, thus reducing the costs of tooling for and maintaining an inventory of a variety of different components. The corner and end assemblies are rigidly fastened to the adjacent rail sections and thus provide structural continuity between rail sections, in the case of corner assemblies, and along a return to the wall at the terminal end of a rail section, in the case of the end assembly. They present a substantially unbroken impact surface and substantially complete visual continuity. Further cost advantages are derived from the fact that the field labor required to install corners and end terminations is minimized.

An internal corner assembly includes two short pieces of retainer joined at a right angle by an internal corner connector of substantially uniform, generally W-shaped cross section. The connector includes, in cross section, a right angle V-shaped center portion and a pair of legs extending outwardly from the center portion, each leg being joined to a respective one of the retainer pieces of the assembly. A special corner cover member is formed from a short length of cover profile by slitting the flanges transversely perpendicular to the impact wall portion and bending the impact wall portion along a line transverse to the longitudinal axis of the piece. Thus, the cover member has integrally-joined impact wall portions disposed at right angles to each other and upper and lower flanges joined to each wall portion. An end cap having an external surface shaped generally as one quadrant of a circular cylinder is received in the V-shaped portion of the connector.

An external corner assembly for the rail system comprises a connector of substantially uniform, generally X-shaped cross section along planes perpendicular to a vertical axis which includes a pair of inwardly located legs adapted to be connected to the retainers of the rail sections being joined and a pair of outwardly located legs intersecting at a right angle. An end cap substantially identical to the one used in an internal corner assembly is received in the space defined by the outwardly located legs of the connector and is fastened in place by fasteners which extend through the outwardly located legs. Preferably, each of the outwardly located legs has a flange at its free end which turns outwardly, relative to the end cap, and is adapted to extend under and abut the inner surface of the impact wall portion of the adjacent cover of the rail section to which the external corner assembly is joined.

An end assembly employs a short length of retainer and an X-shaped external corner connector identical to that used at an external corner. In essence, an end assembly is identical to an external corner assembly except for the fact that a short length of retainer and a short length of cover are installed on one inwardly located leg of the corner connector.

For a further understanding of the invention, reference may be made to the following description of an exemplary embodiment, taken in conjunction with the figures of the accompanying drawings.

DESCRIPTIONS OF AN EXEMPLARY EMBODIMENT

Figure 1:
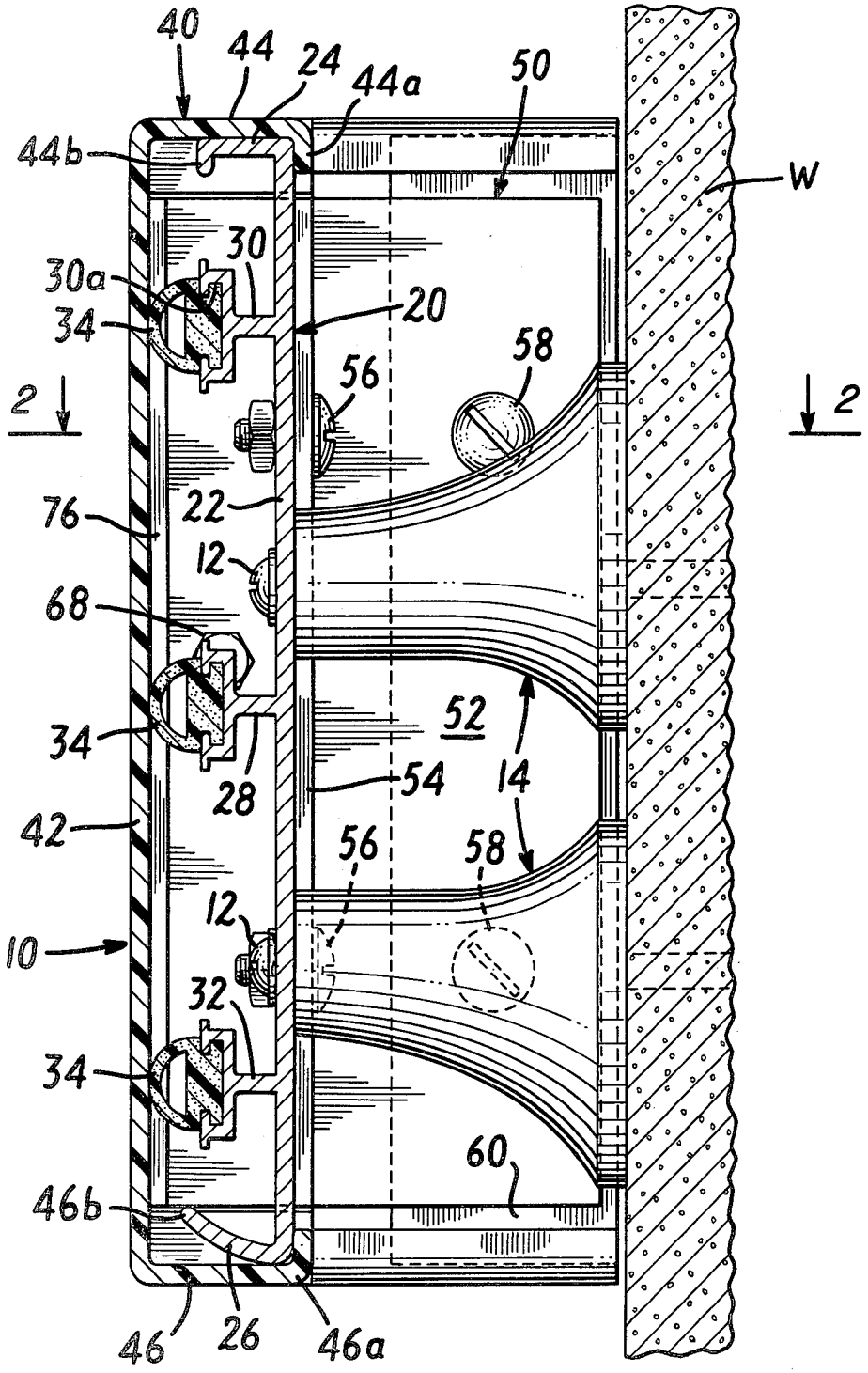
FIG. 1 is an end cross-sectional view of a rail section having an end assembly installed thereon, the view being taken in the direction looking toward the end assembly, as indicated by the lines 1—1 and the direction of the arrows in FIG. 2.
Figure 2:
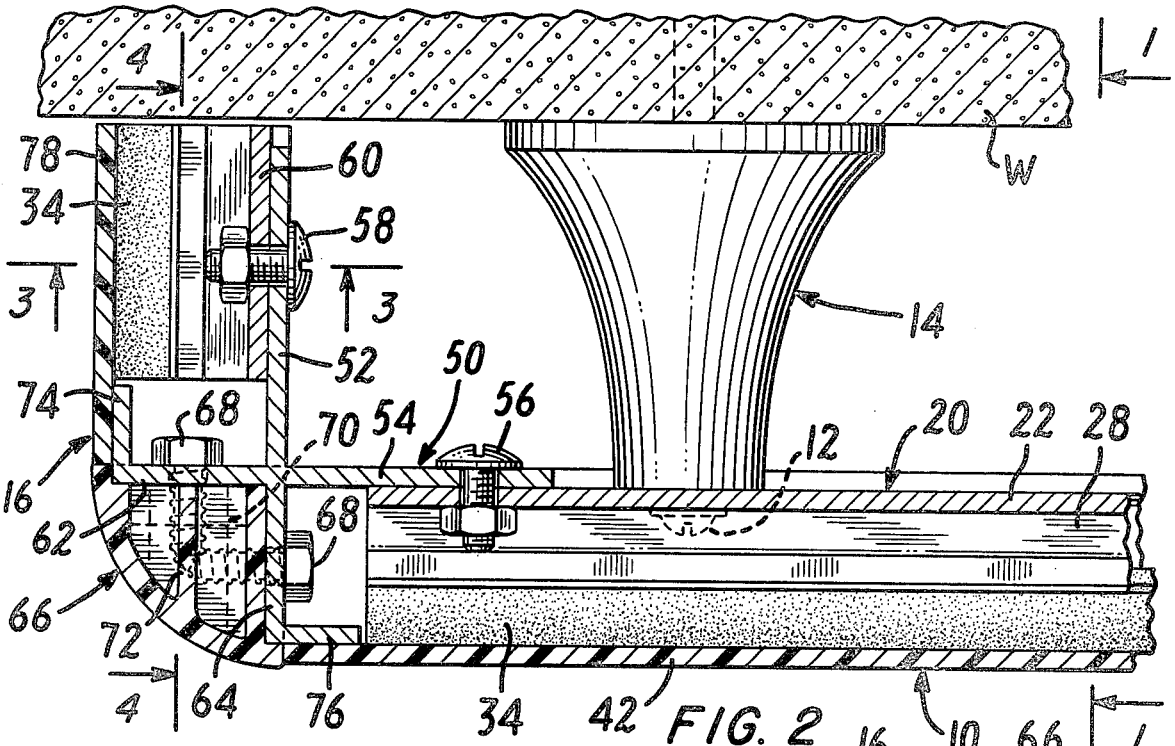
FIG. 2 is a top cross-sectional view of the end portion of the rail shown in FIG. 1 taken generally along the lines 2—2 of FIG. 1 in the direction of the arrows.
Figure 3:
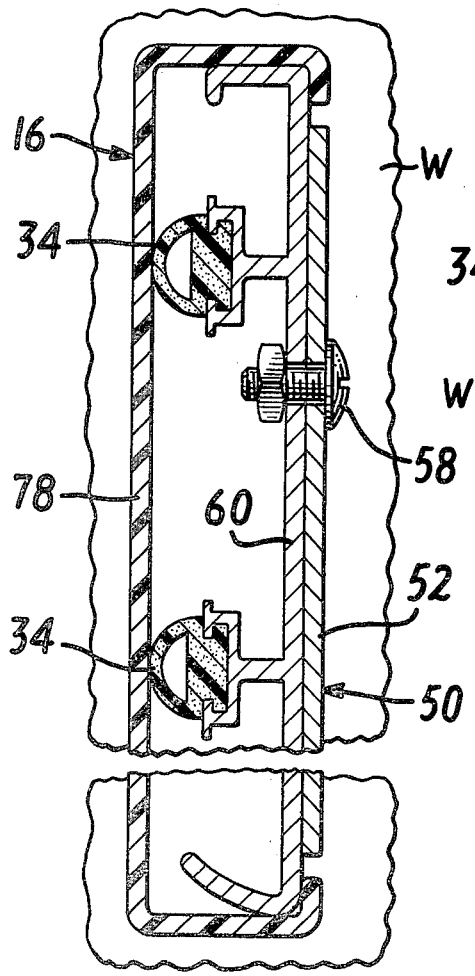
FIG. 3 is a cross-sectional view taken generally along the lines 3—3 of FIG. 2 and in the direction of the arrows.
Figure 4:
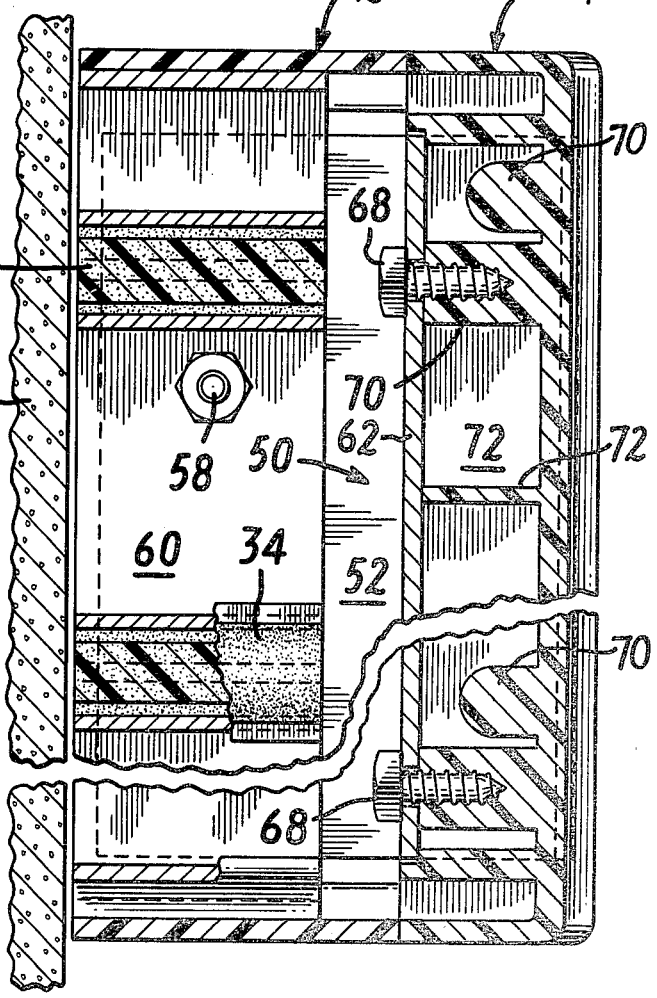
FIG. 4 is a cross-sectional view taken generally along the lines 4—4 of FIG. 2 and in the direction of the arrows.

FIGS. 1 through 4 of the drawings illustrate the end portion of a rail section 10 which is mounted by means of fasteners 12 and spacers 14 on a wall W, the spacers 14 providing a stand-off distance between the rail 10 and the wall W. The fasteners and spacers 14 are merely exemplary of wall-mounting elements that can be used with the rail system, and numerous specific arrangements are possible. The hand rail can also be attached to posts or to any other support in any suitable manner. FIGS. 1 through 4 also illustrate an end assembly 16 for turning the terminal end of a rail section toward the wall, something which is generally desirable and sometimes required by safety regulations.

The rail section 10 comprises an elongated, substantially rigid retainer 20 having a web or medial portion 22 and upper and lower retainer flanges 24 and 26, respectively. The retainer 20 is preferably manufactured by extrusion from aluminum, and as so manufactured is of substantially uniform cross section along its length. A longitudinally extending, centrally located rib 28 of generally "T"-shaped cross section projects outwardly, relative to the wall W from the medial portion of the retainer 20, and identical upper and lower ribs 30 and 32 are located between the central rib 28 and the respective upper and lower flanges 24 and 26. Each of the ribs 28, 30 and 32 has an outwardly open, undercut groove (e.g., 30*a*) which receives a complementary shaped base segment of a resiliently compressible cushion 34. Each of the cushions 34 mounted on the respective ribs 28, 30 and 32 extends continuously along the length of the retainer and is formed of a semi-rigid polyvinyl chloride material, and is hollow adjacent to its outward extremity, thus to define a relatively flexible wall which deforms upon application of a force in a direction toward the wall W.

The second principal component of the rail section 10, the cover 40, is also of uniform cross section along its length and is made by extrusion of an impact resistant, resilient polymeric material such as a mixture of polyvinyl chloride and acrylic polymers. The cover 40 includes a flat impact wall portion 42 and upper and lower flanges 44 and 46, each of which has an inturned end 44*a* and 46*a*, respectively. The flanges are formed to a slightly less than 90° internal angle with the impact wall portion so that when the cover is installed on the retainer the flanges firmly grip the retainer flanges 24 and 26 with a moderate inward preload force due to the resiliency of the polymeric material and the slight spreading of the flanges when the cover is in place on the retainer. The lower retainer flange 26 is curved, and the outwardly and downwardly facing surface serves as a cam that facilitates pushing the cover into place on the retainer by first seating the upper flange 44 of the cover in place on the upper retainer flange 24 and then pushing the lower edge of the cover in the direction of the wall. The resiliency of the cover material allows the lower flange to be cammed downwardly until it snaps into place with the inturned portion 46*a* engaged behind the lower edge of the retainer flange.

The surfaces 44*b* and 46*b* of the retainer flanges which face outwardly, relative to the wall, are spaced inwardly some distance from the parts of the impact wall portion of the cover immediately outwardly therefrom, thus to provide clearances between the impact wall portion of the cover and the surfaces 44*b* and 46*b* which allow the cover member to deflect toward the retainer upon impact. Meanwhile, the resilient cushions 34 urge the cover member outwardly away from the wall to a normal position in which the cover is firmly held outwardly with the inturned portions 44*a* and 46*a* of the flanges tight against the back of the retainer flanges 24 and 26.

Upon an impact against the wall portion 42 of the cover member, the cushions in the region of the impact deform resiliently and allow the cover in the impacted region to deflect toward the retainer and absorb some of the energy of the impact. Immediately after impact, the resilient cushions 34 restore the cover to its original position. The central cushion 34 (the one mounted on the central rib 28 of the retainer 20) is of particular importance in that it prevents the center part of the impact wall portion of the cover from excessive deformation and, in particular, deformation to an extent such that the inturned portions of the flanges 44 and 46 (or either one) becomes dislodged from behind the retainer. The energy of an impact to the rail is absorbed primarily by compression of the cushions 34 in the region around the impact, though part of the energy of the impact is borne by deformation of the cover member.

The upper retainer flange 24 rigidly supports the major portion of the upper flange 44 of the cover 10, thus providing a rigid handhold. The upper cushion assists in maintaining the stability of the handhold portion, i.e., the upper portion of the rail assembly, in the particular embodiment, which has a substantial height, say about eight inches overall. A relatively narrow handrail and crash rail embodying the present invention may not require more than one or two cushions to provide a stable handhold while affording controlled deflection and deformation of the cover. In such cases, the cushions can be located at various vertical positions on the medial portion of the retainer 20 between the upper and lower retainer flanges.

The end assembly 16 includes an external corner connector 50 which, as viewed from the top, is generally X-shaped and is of uniform cross section along its vertical extent, i.e., in planes perpendicular to the vertical. It is preferably formed by extrusion from aluminum and cut to a length approximately equal to the distance between the ends of the inturned portions *44a* and *46a* of the cover flanges and includes a pair of inwardly located legs 52 and 54, one of which is secured by bolts 56 or some other suitable fastener to the medial wall of the retainer 20 and the other of which is secured by bolts 58 to a short piece 60 of the retainer. The short piece 60 has cushions 34 in place and, indeed, in every respect is merely a short section of the retainer subassembly (the retainer cross section and the cushions). The connector 50 also includes a pair of outwardly located legs 62 and 64 which intersect at right angles and receive an end cap 66. The external surface of the end cap 66 is shaped generally as one quadrant of a circular cylinder and has a peripheral bead which allows it to nest in the space defined between the legs 62 and 64 with the beads overlying and concealing the upper, outer and lower edges of the flanges 62 and 64. Accordingly, the edges of the end piece 66 abut the ends of the covers along the top, front and bottom of each juncture between a cover section and the end piece. The end piece 66 is fastened by screws 68 to the legs 62 and 64, the end piece 66 having internal bosses 70 to receive the screws 68. An internal network of webs 72 interconnects the bosses and walls and rigidifies and strengthens the end piece.

Each of the outwardly located legs 62 and 64 has a flange 74 and 76, respectively, extending outwardly (relative to the end piece) from its free end. The external surface of each flange 74 or 76 extends under and abuts the end part of the impact wall portion of the adjacent cover and, therefore, prevents the end parts of the covers from being deflected by an impact and exposing the edge of the end piece 66 adjacent thereto to an impact force acting generally parallel to the wall and in a direction away from the main rail section toward the end piece. Accordingly, the possibility of the end piece being dislodged by a glancing blow is minimized.

The remaining component of the end assembly shown in FIGS. 1 through 4 is a short piece 78 of cover which is installed over the retainer piece 60. The end assembly 50, therefore, consists of the connector 50, the end piece 66, the retainer piece 60 and cover piece 78. All that needs to be done in the field to install the rail system is to bolt the end assembly to the end of the rail section, which can readily be done before the cover of the rail section is installed.

The only difference between the end assembly shown in FIGS. 1 to 4 and an external corner assembly for use with the rail system is that the short lengths of retainer and cover (60 and 78) are omitted. An end assembly consists of an external corner connector 50 and an end cap 66 installed on the connector. If one considers the short pieces of retainer and cover 60 and 78 shown in FIGS. 1 to 4 as being the terminal portions of a length of rail running along a wall perpendicular to the wall W, the manner of assembly of the end assembly to the rail sections at an external corner is readily apparent from the foregoing description and from examination of FIGS. 1 to 4. It will be observed that the retainer of a rail section is cut to a slightly shorter length than the cover to allow for reception of the flange 74 or 76 in overlapping relation to the cover section and to avoid interference between a flange 74 or 76 of the connector 50 and the retainer of the adjacent rail section.

Figures 5, 7:
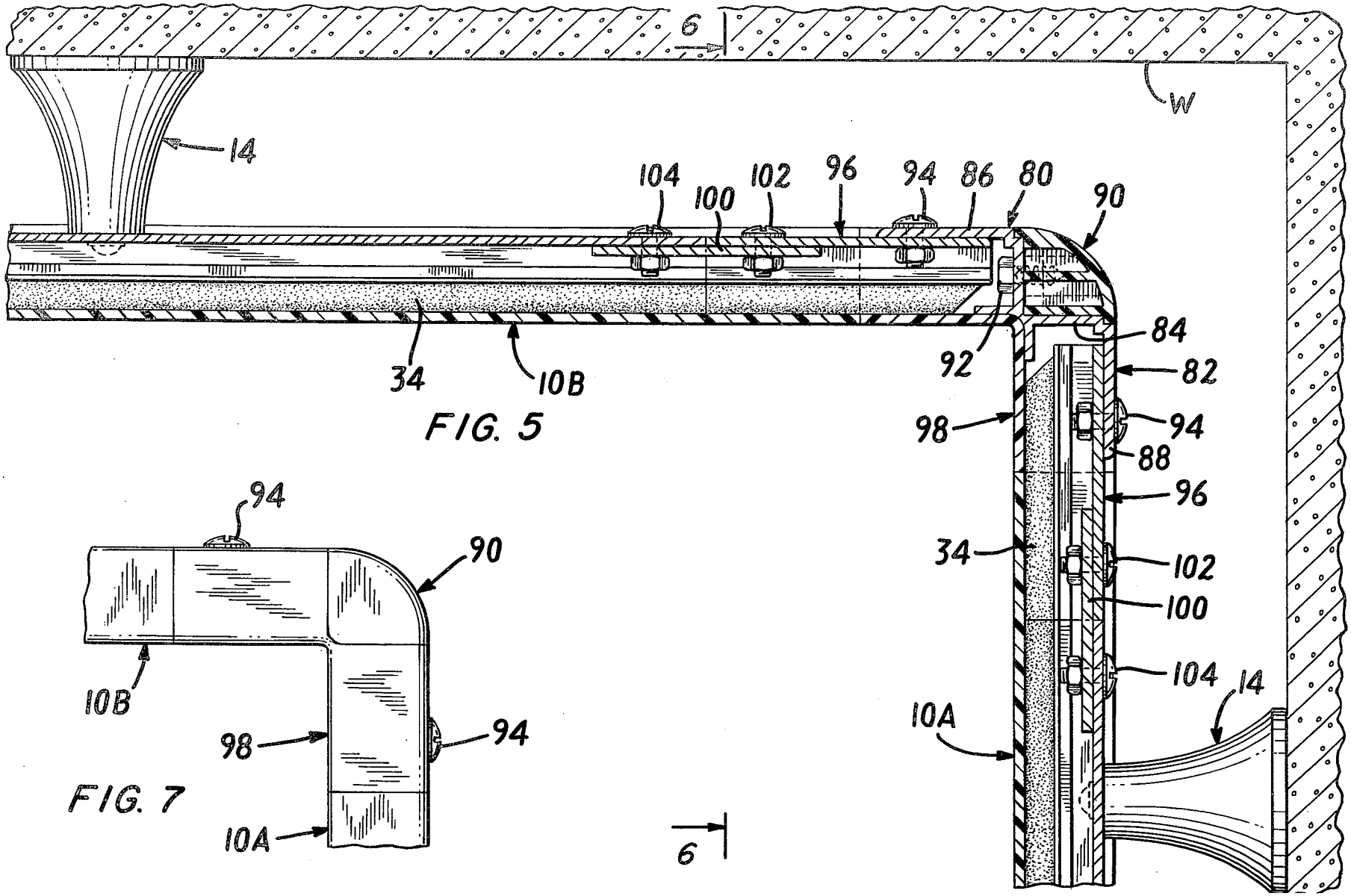
FIG. 5 is a top cross-sectional view of two sections of rail joined by an internal corner assembly, the section being taken just below the upper flanges of the retainer and cover.
FIG. 7 is a top view of an internal corner assembly and parts of the adjoining rail sections.
Figure 6:
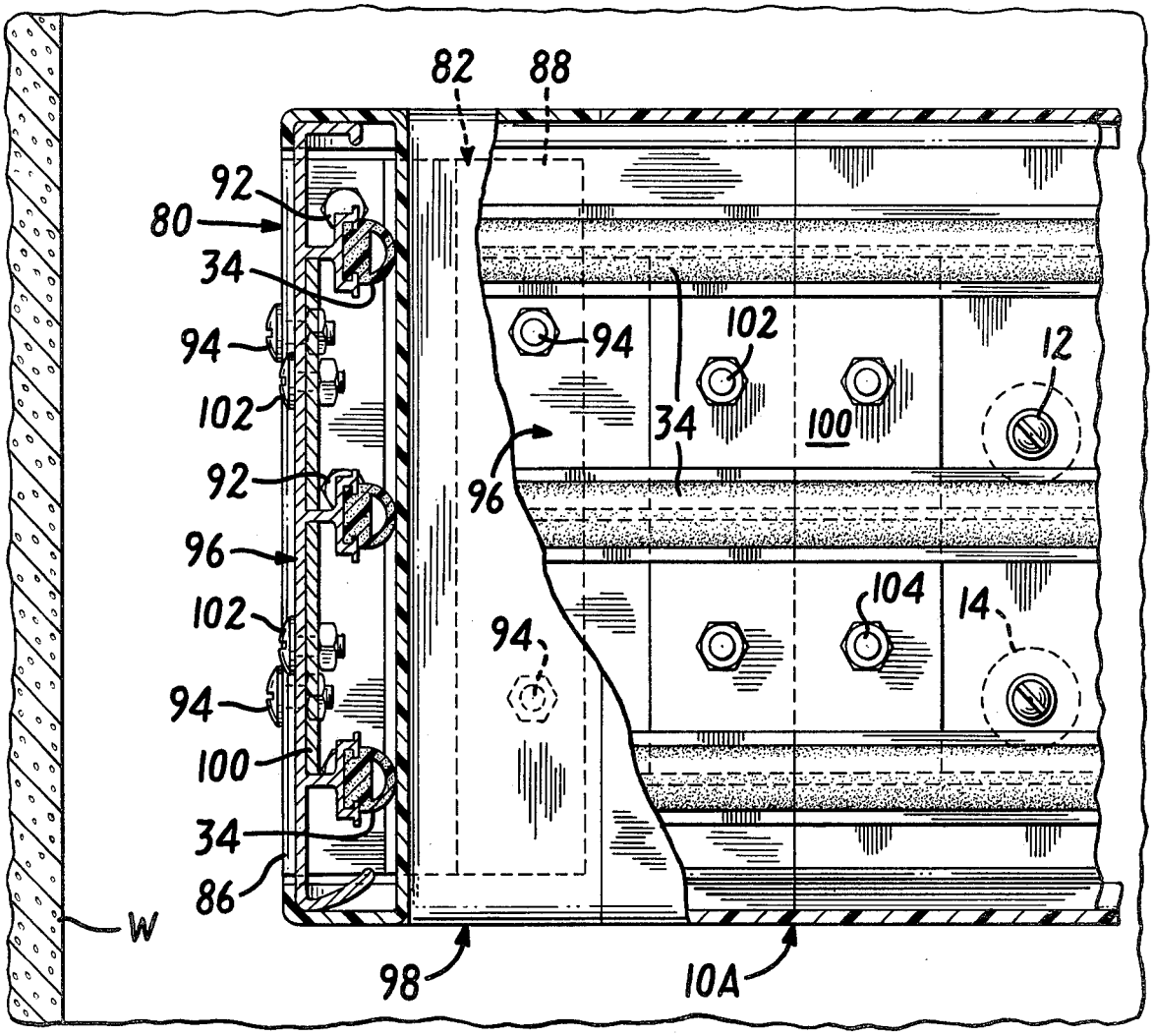
FIG. 6 is a cross-sectional view of the corner assembly shown in FIG. 5 taken generally along the lines 6—6 of FIG. 5 and in the direction of the arrows with a portion of the cover being broken away to show the concealed parts of the assembly.

FIGS. 5 to 7 illustrate an internal corner assembly 80 for joining rail sections 10A and 10B. The assembly 80 includes an internal corner connector 82 which is a member of generally "W" shape in cross section taken along planes perpendicular to a vertical axis (i.e., vertically with respect to the connector as installed). It is preferably a piece cut from an aluminum extrusion of the desired profile. The connector includes, in cross section, a right angle V-shaped center portion 84 and a pair of legs 86 and 88 which extend out at right angles from the free ends of the legs of the V-shaped portion 84. An end cap 90, which is substantially identical to the end cap 66 of an end assembly or external corner assembly except for a rounded edge at the apex of the V-shaped portion 84, is fastened by screws 92 to the V-shaped portion 84. Each of the legs 86 and 88 is fastened by bolts 94 to a short piece 96 of retainer, each piece 96 having resilient cushions 34 in place. A special internal corner cover 98 is fabricated from a piece of cover cross section by slitting the upper and lower flanges 44 and 46 (see FIG. 1) transversely perpendicular to the impact wall portion and then heat-forming the impact wall portion along a line perpendicular to the axis of the cover cross section so that the original flat front wall portion is folded at a right angle. The corner piece 98, thus, consists of a unitary impact wall portion and two pairs of upper and lower flanges, the edges of which are at right angles and will neatly match the edges of the upper and lower ends of the end piece 90, as may best be seen in FIG. 7. The internal corner assembly, finally, comprises two pairs of splice plates 100 which are bolted to the end portions of the retainer pieces 96 by bolts 102.

The internal corner assembly is preferably preassembled at the factory, thus speeding up field installation. It is installed by merely bolting the free ends of the splice plates 100 to the retainers of the rail sections 10A and 10B, respectively, by means of bolts 104. The covers of the rail sections 10A and 10B are cut to a length somewhat longer than the retainers so that the end portions of the covers of the rail sections 10A and 10B will overlap the retainer pieces 96 of the corner assembly and will form a butt joint with the central corner cover 98 (see FIGS. 5 and 7).

For long runs of rail, sections of retainer are joined by splice plates 100. The butt joints of the covers at splices are, preferably, non-coincident with the joints between retainers.

The above-described embodiment of the present invention is merely exemplary, and numerous variations and modifications will be readily apparent to those skilled in the art without departing from the spirit and scope of the invention. All such variations and modifications are intended to be included within the scope of the invention as defined in the appended claims.

I claim:

1. In a handrail and crash rail which includes a substantially rigid elongated retainer of uniform cross section along its length and having in cross section a medial portion and upper and lower flanges and a cover of a resilient impact-resistant polymeric material having an impact wall portion and upper and lower flanges joined integrally to the impact wall portion, the respective upper and lower flanges of the retainer and cover being in engagement so that the cover is held on the retainer and the medial portion of retainer and the impact wall portion of the cover being spaced-apart to allow deflection of the cover toward the retainer upon impact, the improvements wherein there is a rib on the retainer located about midway between the retainer flanges, projecting toward the cover from the medial portion of the retainer and imparting longitudinal rigidity thereto, wherein there is at least one longitudinally extending resilient compressible cushion mounted on the rib and engaging the impact wall portion of the cover, and wherein there are clearances between the front surfaces of the retainer flanges and the portions of the cover outwardly therefrom so that the impact wall portion of the cover can deflect toward the retainer throughout its vertical extent upon impact and is restored to its initial position by the cushion.

2. The improvements according to claim 1, wherein there are upper and lower longitudinally extending resiliently compressible cushions engaged between the retainer and cover, whereby the upper and lower cushions act together in permitting limited deflection of the cover toward the retainer upon impact and restoring the cover to its initial position after impact.

3. The improvements according to claim 1, wherein there are upper and lower cushions mounted on ribs which project toward the cover from the medial portion of the retainer and impart longitudinal rigidity thereto.

4. The improvements according to claim 1, and further comprising for use at an internal corner intersection between rail sections an internal corner assembly which includes two short pieces of retainer joined at a right angle by an internal corner connector, the connector being of substantially uniform generally W-shaped cross section in planes transverse to a vertical axis and including in cross section a right angle V-shaped center portion and a pair of legs extending outwardly from the center portion, each leg being joined to the medial portion of a respective retainer piece, and an end cap having an external surface shaped generally as one quadrant of a circular cylinder and received in the V-shaped portion of the connector and joined thereto by fasteners extending into it through the connector.

5. The improvements according to claim 4, wherein the internal corner assembly further includes a corner cover member received on the retainer pieces, the corner cover member being of the same cross section as the cover and formed into a right angle by slitting the flanges of a short piece of cover transversely perpendicular to the impact wall portion and bending the impact wall portion along a line transverse to the longitudinal axis of the piece, the corner cover member thus having integrally joined impact wall portions disposed at right angles to each other and upper and lower flanges joined to each impact wall portion, and wherein the upper and lower ends of the end cap abut and lie flush with the respective upper and lower flanges of the corner cover member.

6. The improvements according to claim 1, and further comprising an external corner assembly for joining rail sections at right angles at an external corner and including an external corner connector of substantially uniform generally X-shaped cross section along planes perpendicular to a vertical axis and including a pair of inwardly located legs adapted to be connected to the retainers of the rail sections being joined and a pair of outwardly located legs intersecting at a right angle, and an end cap having an external surface shaped generally as one quadrant of a circular cylinder and received in the space defined by the outwardly located legs of the connector and fastened thereto by fasteners which extend through the outwardly located legs.

7. The improvements according to claim 6, wherein each of the outwardly located legs of the external corner connector has a flange at its free end which turns outwardly, relative to the end cap, and is adapted to extend under and abut the inner surface of the impact wall portion of the adjacent cover of the rail section to which the external corner assembly is joined.

8. The improvements according to claim 1 and further comprising, for turning the rail to a wall at an exposed end, an end assembly which includes a short length of retainer, an external corner connector of substantially uniform generally X-shaped cross section along planes perpendicular to a vertical axis and including a pair of inwardly located legs, one of the legs being connected to the retainer of the rail and the other leg being connected to the short length of retainer, and a pair of outwardly located legs intersecting at a right angle, and an end cap having an external surface shaped generally as one quadrant of a circular cylinder and received in the space defined by the outwardly located legs of the connector and fastened thereto by fasteners which extend through the outwardly located legs.

9. The improvements according to claim 8, wherein each of the outwardly located legs of the external corner connector has a flange at its free end which turns outwardly, relative to the end cap, and is adapted to extend under and abut the inner surface of the impact wall portion of the cover of the adjacent rail section to which the corner assembly is joined.

* * * * *